US008240956B2

(12) United States Patent
Lewis

(10) Patent No.: US 8,240,956 B2
(45) Date of Patent: Aug. 14, 2012

(54) SYSTEM AND METHOD FOR MODULARLY DEPLOYABLE AND SCALABLE COMPRESSED AIR ENERGY ACCUMULATOR

(75) Inventor: Cameron Phillip Lewis, Toronto (CA)

(73) Assignee: Eydrostor Inc., Toronto, Ontario (CA)

( * ) Notice: Subject to any disclaimer, the term of this patent is extended or adjusted under 35 U.S.C. 154(b) by 204 days.

(21) Appl. No.: 12/761,099

(22) Filed: Apr. 15, 2010

(65) Prior Publication Data

US 2011/0253558 A1 Oct. 20, 2011

(51) Int. Cl.
*E02D 27/38* (2006.01)
*B65D 88/78* (2006.01)

(52) U.S. Cl. ..... 405/210; 114/257

(58) Field of Classification Search ..... 405/210; 114/257; 441/1, 23–26, 30
See application file for complete search history.

(56) References Cited

U.S. PATENT DOCUMENTS

2003/0116191 A1* 6/2003 Dobies et al. ..... 137/204
2004/0191000 A1* 9/2004 Webster et al. ..... 405/210

FOREIGN PATENT DOCUMENTS

CA 2467287 A1 11/2005
EP 1536541 A1 * 6/2005
JP 58214608 A 12/1983
WO 2007066117 A1 6/2007
WO 2009024933 A2 2/2009

OTHER PUBLICATIONS

International Search Report issued by the Canadian Intellectual Property Office dated Jul. 15, 2011 for corresponding International Application No. PCT/CA2011/000343 filed Mar. 30, 2011.
Written Opinion of the International Searching Authority issued by the Canadian Intellectual Property Office dated Jul. 15, 2011 for corresponding International Application No. PCT/CA2011/000343 filed Mar. 30, 2011.

* cited by examiner

*Primary Examiner* — John Kreck
*Assistant Examiner* — Kyle Armstrong

(57) ABSTRACT

A modular energy accumulator system using compressed air. The system comprises a plurality of bladder modules disposed underwater for subjection to a hydrostatic ambient pressure. The plurality of bladder modules include a first bladder module and at least a second bladder module, each of the bladder modules being oriented substantially longitudinally about a vertical axis when made buoyant by ingress of compressed air. An interconnection pipe assembly is configured to facilitate ingress of compressed air into the bladder modules to a pressure level substantially equal to the hydrostatic ambient pressure, and also to facilitate egress of air from the bladder modules at the hydrostatic ambient pressure. The bladder modules are tethered for being maintained in the underwater disposition.

18 Claims, 3 Drawing Sheets

SYSTEM AND METHOD FOR MODULARLY DEPLOYABLE AND SCALABLE COMPRESSED AIR ENERGY ACCUMULATOR

FIELD

The present disclosure relates generally to a system and method for providing a modularly deployable, scalable energy accumulator based on compressed air.

BACKGROUND

Electricity storage is highly sought after, in view of the cost disparities incurred when consuming electrical energy from a power grid during peak usage periods, as compared to low usage periods. The addition of renewable energy sources, being inherently of a discontinuous or intermittent supply nature, increases the demand for affordable electrical energy storage worldwide.

Thus there exists a need for effectively storing the electrical energy produced at a power grid or a renewable source during a non-peak period and returning it to the grid upon demand. Furthermore, to the extent that the infrastructural preparation costs, and the environmental impact from implementing such infrastructure are minimized, the utility and desirability of a given solution is enhanced.

SUMMARY OF THE INVENTION

Provided is a bladder module for receiving, storing and discharging compressed air, the bladder module for deployment in an energy accumulator system. The bladder module comprises a variable volume bladder for subjection to an ambient hydrostatic pressure when disposed underwater, the variable volume bladder configured for ingress and egress of compressed air, the variable volume bladder made buoyant when storing compressed air at substantially the ambient hydrostatic pressure, the variable volume bladder oriented substantially longitudinally about a vertical axis when made buoyant by ingress of compressed air thereinto, in the underwater disposition, and a tether assembly anchoring the variable volume bladder made buoyant in the underwater disposition.

Also provided is a modular energy accumulator system using compressed air. The system comprises a plurality of bladder modules disposed underwater for subjection to a hydrostatic ambient pressure, the plurality of bladder modules including a first bladder module and at least a second bladder module, each of the bladder modules being oriented substantially longitudinally about a vertical axis when made buoyant by ingress of compressed air thereinto, and an interconnection pipe assembly configured to facilitate ingress of compressed air into the bladder modules up to a pressure level substantially equal to the hydrostatic ambient pressure, and also configured to facilitate egress of air from the bladder modules at the hydrostatic ambient pressure, wherein each bladder module is tethered for being maintained in the underwater disposition.

Further provided is a method of receiving, storing and discharging compressed air energy using a plurality of bladder modules disposed underwater by a plurality of tethers, the underwater disposition for subjecting the plurality of bladders to a hydrostatic ambient pressure, the plurality of bladder modules including a first bladder module and at least a second bladder module. The method comprises receiving, via an interconnection pipe assembly, an inflow of compressed air to fill the plurality of bladder modules to a volume creating a buoyant condition, the bladder modules being at substantially a same depth underwater for subjection to substantially a common hydrostatic ambient pressure, the bladder modules when in the buoyant condition being oriented substantially longitudinally about a vertical axis, storing, at the common hydrostatic ambient pressure, the received air within the plurality of bladder modules, and discharging the air stored at the common hydrostatic ambient pressure from the plurality of bladder modules via the interconnection pipe assembly, the air being discharged at a substantially constant discharge pressure.

BRIEF DESCRIPTION OF THE DRAWINGS

Embodiments will now be described by way of example only, with reference to the following drawings in which.

DETAILED DESCRIPTION

Presented herein is a system and method for storage of electrical energy in a manner for deployment of same upon demand, more specifically, a modular and scalable underwater compressed air energy system, requiring minimal infrastructural preparation costs for deployment.

Figure 1:
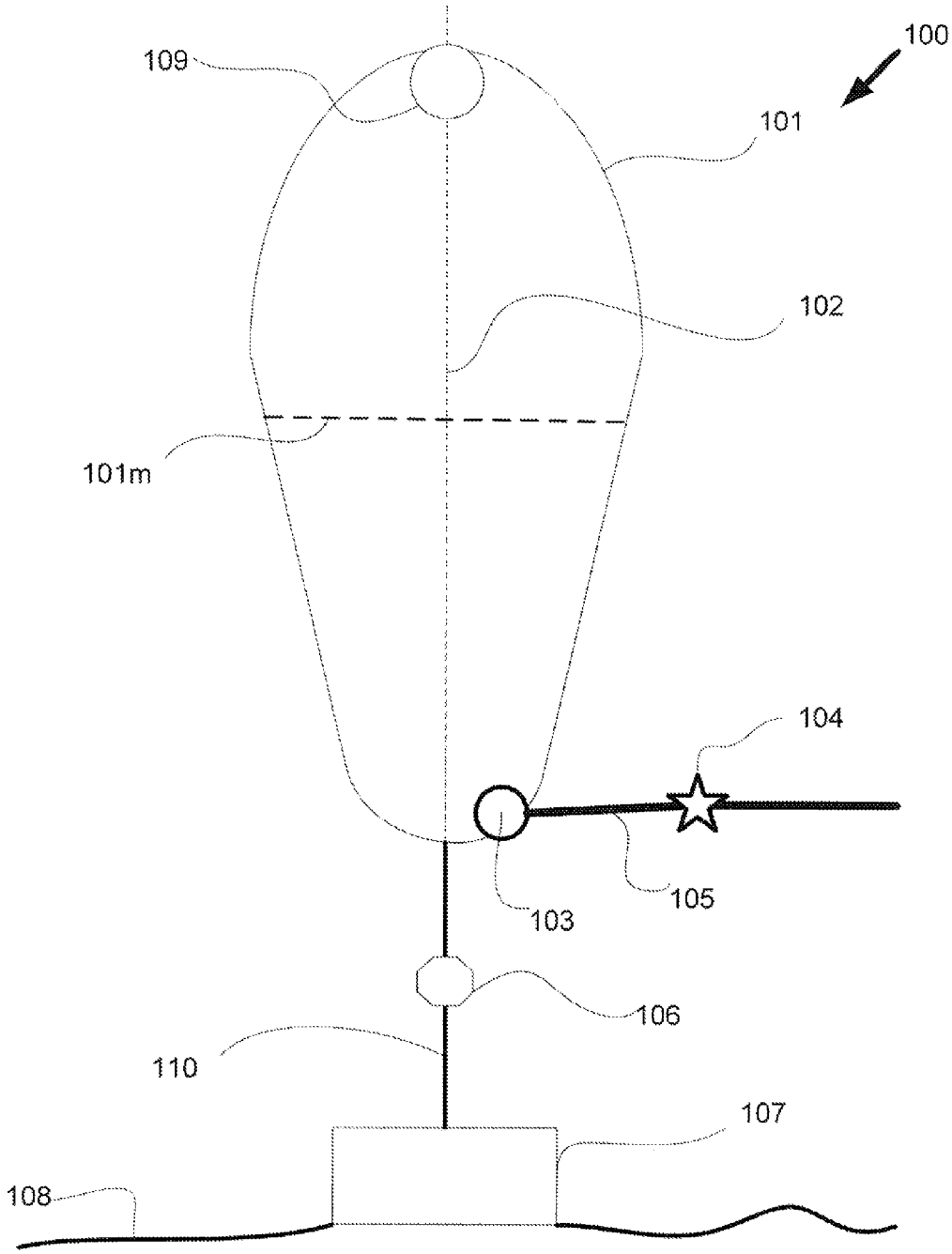
FIG. 1 illustrates an exemplary configuration of a single bladder module of the energy accumulator system.

FIG. 1 illustrates an exemplary configuration of a single bladder module 100 of the energy accumulator system. Bladder module 100, disposed at an underwater depth within a body of water such as a lake or sea, receives, stores and discharges compressed air for deployment in the energy accumulator system. Variable volume bladder 101 of bladder module 100 is subjected to an ambient hydrostatic pressure when disposed underwater, the ambient hydrostatic pressure being provided by the water column above and surrounding variable volume bladder 101.

Still with reference to FIG. 1, variable volume bladder 101 may include inlet and outlet valves 103 and associated piping assembly 105 to facilitate ingress and egress of compressed air. Piping assembly 105 may include safety shutoff valve 104, and further incorporate a volumetric flow meter to keep track of the flow of compressed air into variable volume bladder 101. It is apparent that any air stored within variable volume bladder 101 will be stored at the ambient hydrostatic pressure. Furthermore, when the stored air is discharged from variable volume bladder 101, such as by opening outlet valve 103, that discharge pressure is governed by the ambient hydrostatic pressure. The ambient hydrostatic pressure depends on the depth of variable volume bladder 101 underwater. Thus, once the discharge pressure is defined, then an underwater depth for locating variable volume bladder 101 can be calculated which provides an ambient hydrostatic pressure accordingly. Since the hydrostatic pressure is constant for a given depth, therefore the stored air can be discharged via piping assembly 105 at that constant pressure.

Variable volume bladder 101 may include an over-pressure relief valve 109, to protect against over-inflation and over-pressurization. To the extent that variable volume bladder 101 is only pressurized to a level corresponding to the ambient hydrostatic pressure, and not exceeding same, variable volume bladder 101 does not need to meet standards for operation applicable to pressure vessels, and any increased material costs attendant thereto.

Thus, in its operational condition, variable volume bladder 101 may be filled to its maximum volume with air pressurized generally to a level equal to the ambient hydrostatic pressure. In this state, it is apparent that variable volume bladder 101 will comprise a buoyant condition, being subjected to an upwardly thrusting buoyancy force. In this buoyant condition, variable volume bladder 101 is depicted in a side view in FIG. 1 as being oriented longitudinally about a vertical axis 102. Variable volume bladder 101 may be anchored to the lake-bed, or sea-bed 108, via a tethering assembly comprised of a tether line 110 securing variable volume bladder 101 to a ballast 107 disposed on the lake- or sea-bed 108. It is evident that the weight of ballast 107 must be at least sufficient to counteract the upwardly thrusting buoyancy force in order to anchor variable volume bladder 101.

Optionally, a buoyancy sensor 106 may be applied to the tether line 110 to sense the upward thrust that variable volume bladder 101 is subjected to at all times. Thus in an emergency situation where, for example, variable volume bladder 101 may be separated from its tether line, the resultant reduction in upward thrust at buoyancy sensor 106 may be sensed and wirelessly communicated to activate shutoff valve 104, creating a failsafe mechanism that pre-empts any free flowing or pressurized air at pipe assembly 105. Again, optionally, as contemplated and described above, shutoff valve 104 may incorporate or be allied with a volumetric gas flow meter, the volume of bladder 101 may be monitored. This provides capability for the buoyancy sensor 106 to detect the volume of the bag. As bladder 101 fills with compressed air, its buoyancy is increased and can be measured to keep track of the volume of air purportedly contained in bladder 101.

It is apparent that variable volume bladder 101 may be anchored, or tethered, at any predetermined depth underwater by selecting an appropriate length of tether line 110, for a given depth of ballast 107 at lake- or sea-bed 108. In one embodiment, the ballast comprises a volumetric footprint less than 10 cubic meters.

Variable volume bladder 101, when made buoyant with compressed air to its maximum operational volume, may be oriented in an aspect ratio of at least 0.7:1 in the underwater disposition. For clarity, the term aspect ratio as used herein refers to the ratio of a bladder's width to its height, as measured in the operational condition of the bladder where it is filled with air substantially (meaning at least within about 10%) to its maximum volume. Thus the statement that a bladder's aspect ratio is less than 0.7:1 means that the bladder has gotten narrower and narrower (or "thinner and thinner") in profile as its aspect ratio progressively decreases from the referenced 0.7:1 aspect ratio.

The width of bladder 101 may be measured at a point 101*m* halfway the height of bladder when filled to its maximum operational volume, while the height may measured from top to bottom linearly along a vertical axis 102. It is apparent that a lower aspect ratio enables the most efficient and compact spacing of ballasts and bladder modules to result in less environmental impact due to minimal footprint impressed upon lake or sea-bed 108.

Figure 2:
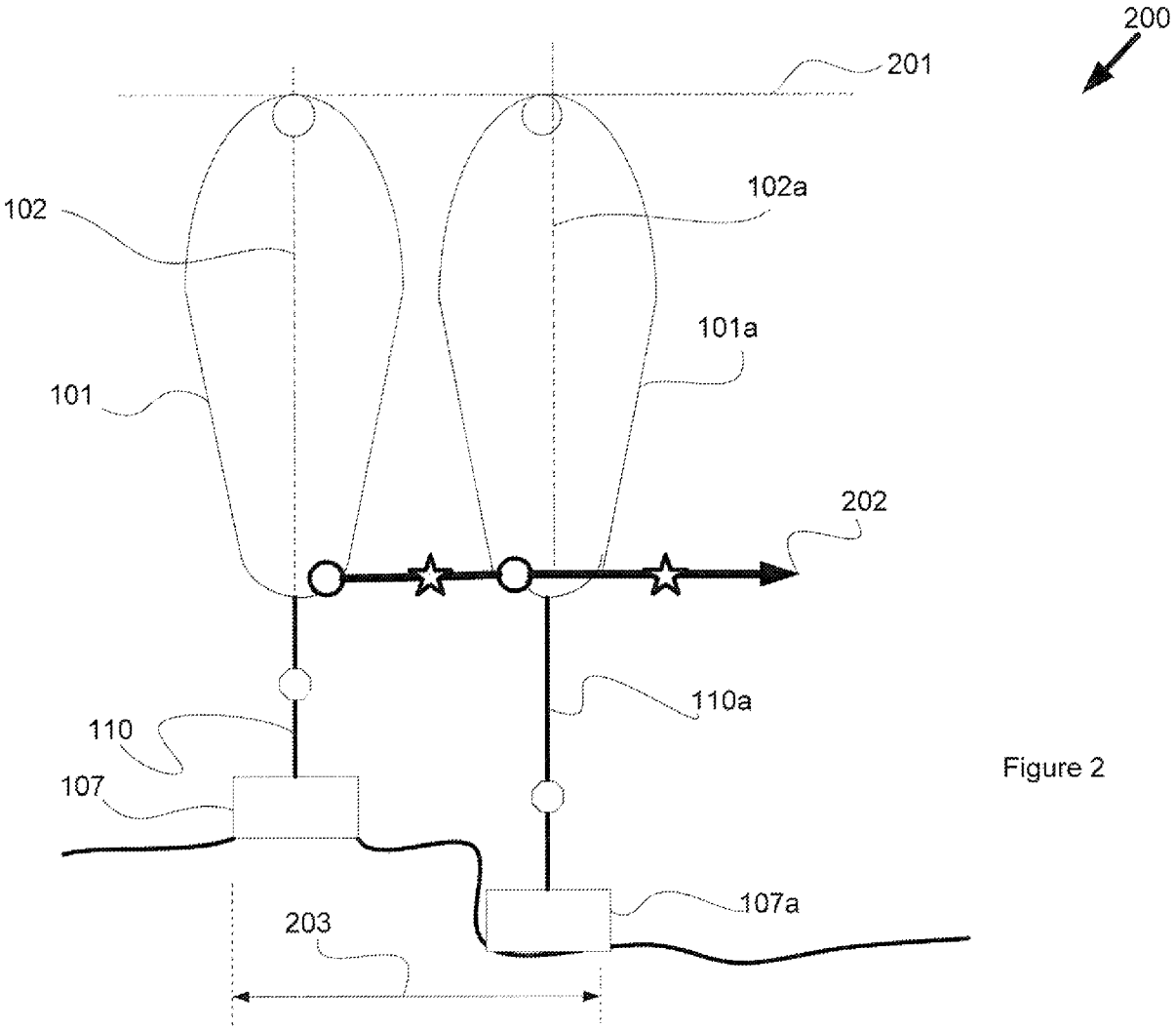
FIG. 2 is a conceptual diagram illustrating deployment, in an exemplary configuration, of a plurality of bladder modules comprising the energy accumulator.

FIG. 2 is a conceptual diagram illustrating deployment, in an exemplary configuration, of a plurality of bladder modules 200 comprising the energy accumulator. Each of the bladder modules generally replicate the structure and configuration described above with regard to FIG. 1, and further are interconnected via piping assembly 105 for ingress and egress of compressed air via an external master coupling 202.

Each of variable volume bladders 101, 101*a* are oriented, when in the operational condition, substantially longitudinally about respective vertical axis 102, 102*a* when made buoyant by ingress of compressed air thereinto.

Interconnection pipe assembly 105 is configured to facilitate ingress of compressed air into the bladders 101, 101*a* up to a pressure level substantially equal to the hydrostatic ambient pressure, and also configured to facilitate egress of air from the bladders 101, 101*a* at the prevailing ambient hydrostatic pressure. Each of bladders 101, 101*a*, in the embodiment depicted in FIG. 2, may be tethered via respective tether lines 110, 110*a* for being maintained in the underwater disposition. It is apparent that to compensate for localized undulations in lake- or sea-bed 107, that tether lines 110, 110*a* may be sized to provide for bladder modules 101, 101*a* being at a same depth 201 underwater, the localized undulations notwithstanding. This ensures that discharged air provided by any of bladders 101, 101*a* will be provided at substantially the same discharge pressure, and constantly at that discharge pressure, since that discharge pressure is governed by the ambient hydrostatic pressure.

In one embodiment, the bladders 101, 101*a* comprise an aspect ratio of 0.7:1 or less as oriented substantially longitudinally about the vertical axis in the buoyant condition. This provides the advantage of having respective ballasts 107, 107*aa* occupy minimal physical footprint 203. Furthermore, such minimal footprint may be realized despite localized undulations in lake- or sea-bed 108, as the lengths selected for respective tether lines 110, 110*a* may be adjusted accordingly. This eliminates the requirement for dredging of lake- or sea-bed 108 prior to deploying any number of bladder modules. A further advantage of maintaining a minimum footprint of ballasts 107, 107*a* in deployment, in addition to a lessened environmental impact, is that lessened variability in ambient pressure and temperature conditions and provides for convenient, easy scaling of energy accumulation capacity via modular arrangements of any number of additional bladder modules.

Figure 3:
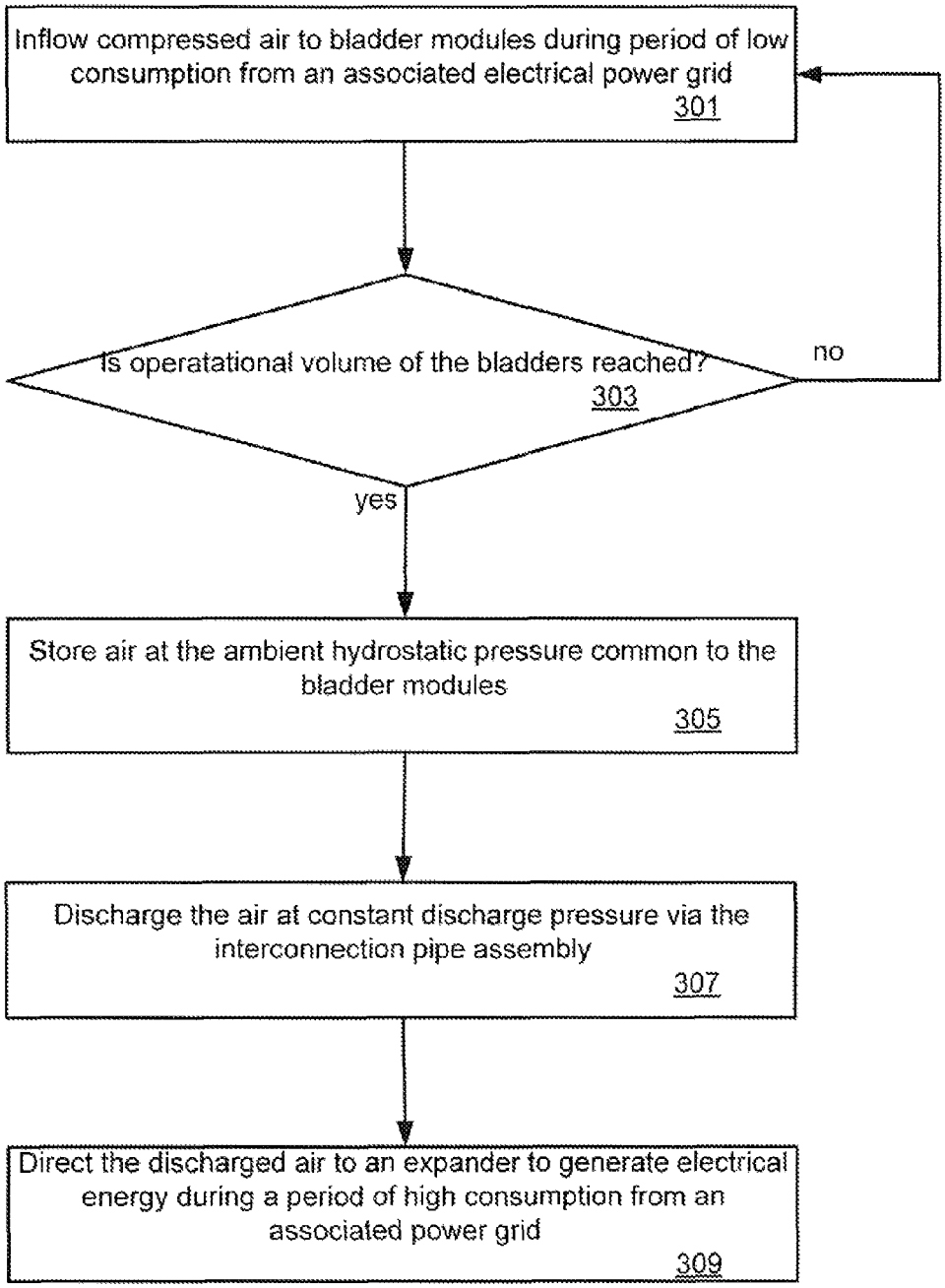
FIG. 3 is a flowchart of an exemplary process including receiving, storing and discharging compressed air of the energy accumulator system.

FIG. 3 depicts an exemplary process including receiving, storing and discharging compressed air of the energy accumulator system. At 301, there is an inflow of compressed air, such as from an external compressor source during a period of low electrical power consumption at a power grid to which the compressor source is coupled to or electrically associated with.

The inflow of compressed air is continued at 303 until the operational or maximum volume of the bladders is reached.

At 305, the compressed air is stored at the common hydrostatic ambient pressure across the plurality of bladders comprising the energy accumulator system.

At 307, the stored air is discharged at generally a constant discharge pressure via interconnection pipe assembly 105.

At 309, the air discharged at constant pressure may be directed to a gas expander to generate electrical energy, such as during a period of peak energy consumption at a power grid, the generated electrical energy being further transmitted to that power grid.

Although specific exemplary embodiments have been used to establish a context for describing the compressed air energy accumulator system, it is contemplated as having much wider applicability within the field of energy conservation and the efficient deployment of energy. Consequently, varying modifications thereof will be apparent to those skilled in the art, without departing from the scope of the invention as defined by the appended claims.

What is claimed is:

1. A bladder module for receiving, storing and discharging compressed air, the bladder module for deployment in an energy accumulator system, the bladder module comprising:

a variable volume bladder for subjection to an ambient hydrostatic pressure when disposed underwater, the variable volume bladder configured for ingress and egress of compressed air via an interconnection pipe assembly having a shutoff valve, the variable volume bladder made buoyant when storing compressed air at substantially the ambient hydrostatic pressure, the variable volume bladder oriented substantially longitudinally about a vertical axis when made buoyant by ingress of compressed air thereinto, in the underwater disposition; and a tether assembly anchoring the variable volume bladder made buoyant in the underwater disposition, the tether assembly including a buoyancy thrust sensor in wireless communication with the shutoff valve, wherein a reduction in buoyancy thrust of the bladder module activates the shutoff valve to pre-empt free-flow of compressed air from the interconnection pipe assembly.

2. The bladder module of claim 1 wherein the variable volume bladder is oriented to comprise an aspect ratio between 0.7 and 1 when made buoyant in the underwater disposition.

3. The bladder module of claim 1 wherein the tether assembly comprises a ballast anchoring the variable volume bladder in the underwater disposition, the ballast comprising a volumetric footprint less than 10 cubic meters.

4. A modular energy accumulator system using compressed air, the system comprising:

a plurality of bladder modules disposed underwater for subjection to a hydrostatic ambient pressure, the plurality of bladder modules including a first bladder module and at least a second bladder module, each of the bladder modules being oriented substantially longitudinally about a vertical axis when made buoyant by ingress of compressed air thereinto; and an interconnection pipe assembly having a shutoff valve, the interconnection pipe assembly configured to facilitate ingress of compressed air into the bladder modules up to a pressure level substantially equal to the hydrostatic ambient pressure, and also configured to facilitate egress of air from the bladder modules at the hydrostatic ambient pressure, ones of the bladder modules having a tether assembly for being maintained in the underwater disposition, the tether assembly including a buoyancy thrust sensor in wireless communication with the shutoff valve, wherein a reduction in buoyancy thrust of the bladder module activates the shutoff valve to preempt free-flow of compressed air from the interconnection pipe assembly.

5. The modular energy accumulator system of claim 4 wherein the first and at least a second bladder modules comprise an aspect ratio between 0.7 and 1 when oriented substantially longitudinally about the vertical axis in the buoyant condition.

6. The modular energy accumulator system of claim 4 wherein the first and at least a second bladder modules are separately tethered via a respective tether line to a respective ballast.

7. The modular energy accumulator system of claim 4 wherein the bladder modules are tethered at substantially the same depth underwater.

8. The modular energy accumulator system of claim 7 wherein tethering the first and at least a second bladder module to substantially the same depth comprises sizing a tether length of a respective tether line such that varying the tether length compensates for any difference in ballast depth due to undulations in sea/lake bed.

9. The modular energy accumulator system of claim 4 further comprising the bladder modules each having a maximum volume condition, and the made buoyant condition is associated with being filled with compressed air to the maximum volume condition.

10. The modular energy accumulator system of claim 4 wherein the plurality of bladder modules being disposed underwater comprises a predefined depth underwater, the predefined depth calculated to result in a desired hydrostatic ambient pressure.

11. The energy accumulator system of claim 4 further comprising at least a third bladder module wherein the energy accumulator system is scaled for increased energy accumulation capability.

12. A method of receiving, storing and discharging compressed air energy using a plurality of bladder modules disposed underwater by a plurality of tethers, the underwater disposition for subjecting the plurality of bladders to a hydrostatic ambient pressure, the plurality of bladder modules including a first bladder module and at least a second bladder module, the method comprising:

receiving, via an interconnection pipe assembly having a shutoff valve, an inflow of compressed air to fill the plurality of bladder modules to a volume creating a buoyant condition, the bladder modules being at substantially a same depth underwater for subjection to substantially a common hydrostatic ambient pressure, the bladder modules when in the buoyant condition being oriented substantially longitudinally about a vertical axis;

storing, at the common hydrostatic ambient pressure, the received air within the plurality of bladder modules;

discharging the air stored at the common hydrostatic ambient pressure from the plurality of bladder modules via the interconnection pipe assembly, the air being discharged at a substantially constant discharge pressure; and sensing a reduction in buoyancy thrust of at least one of the bladder modules to activate the shutoff valve, thereby pre-empting free-flow of compressed air from the interconnection pipe assembly to the at least one of the bladder modules.

13. The method of claim 12 wherein yet at least a third bladder module is coupled to the interconnection pipe, for increased energy accumulation capacity.

14. The method of claim 12 further comprising directing the discharged compressed air to an expander, and expanding the compressed air in the expander to generate electrical energy.

15. The method of claim 12 further comprising transferring the generated electrical energy to an electrical power grid during a period of relatively high energy consumption at the grid.

16. The method of claim 12 further comprising receiving, via the interconnection pipe assembly, the inflow of compressed air to the plurality of bladder modules during a period of relatively low consumption of electrical energy from an associated electrical power grid.

17. A modular energy accumulator system using compressed air, the system comprising:

a plurality of bladder modules disposed underwater by tethering at substantially a same depth for subjection to a hydrostatic ambient pressure, the plurality of bladder modules including a first bladder module and at least a second bladder module, each of the bladder modules oriented substantially longitudinally about a vertical axis when made buoyant by ingress of compressed air thereinto; and an interconnection pipe assembly having a shutoff valve, the interconnection pipe assembly configured to facilitate ingress of compressed air into the bladder modules up to a pressure level substantially equal to the hydrostatic ambient pressure, and also configured to facilitate egress of air from the bladder modules at the hydrostatic ambient pressure, ones of the bladder modules having a tether assembly for being maintained in the underwater disposition, the tether assembly including a buoyancy thrust sensor in wireless communication with the shutoff valve, wherein a reduction in buoyancy thrust of the bladder module activates the shutoff valve to preempt free-flow of compressed air from the interconnection pipe assembly.

18. A method of receiving, storing and discharging compressed air energy using a plurality of bladder modules disposed underwater by a plurality of tethers, the underwater disposition for subjecting the plurality of bladders to a hydrostatic ambient pressure, the plurality of bladder modules including a first bladder module and at least a second bladder module, the method comprising:

receiving, via a first interconnection pipe assembly having a shutoff valve, an inflow of compressed air to fill the plurality of bladder modules to a volume creating a buoyant condition, the bladder modules being at substantially a same depth underwater for subjection to substantially a common hydrostatic ambient pressure when made buoyant, the bladder modules oriented substantially longitudinally about a vertical axis;

storing, at the common hydrostatic ambient pressure, the received air within the plurality of bladder modules;

discharging the air stored at the common hydrostatic ambient pressure from the plurality of bladder modules via a second interconnection pipe assembly, the air being discharged at a substantially constant discharge pressure; and sensing a reduction in buoyancy thrust of at least one of the bladder modules to activate the shutoff valve, thereby pre-empting free-flow of compressed air from the interconnection pipe assembly.

* * * * *